US006516479B1

(12) United States Patent
Barbour

(10) Patent No.: US 6,516,479 B1
(45) Date of Patent: Feb. 11, 2003

(54) FOLDABLE REHABILITATION BED FOR ACCOMMODATING AN OBESE PERSON

(75) Inventor: Jeffrey D. Barbour, Land O'Lakes, Pasco County, FL (US)

(73) Assignee: Burke Mobility Products, Inc., Kansas City, MO (US)

( * ) Notice: Subject to any disclaimer, the term of this patent is extended or adjusted under 35 U.S.C. 154(b) by 0 days.

(21) Appl. No.: 09/588,147

(22) Filed: Jun. 2, 2000

(51) Int. Cl.[7] ..... A61G 7/015; A47C 19/12

(52) U.S. Cl. ..... 5/618; 5/620; 5/611; 5/152

(58) Field of Search ..... 5/620, 618, 617, 5/616, 613, 611, 11, 181, 183, 184, 185, 53.1, 285, 200.1, 201, 202, 152

(56) References Cited

U.S. PATENT DOCUMENTS

| | | | | | |
|---|---|---|---|---|---|
| 323,800 | A | * | 8/1885 | Fenton | 5/152 |
| 631,651 | A | * | 8/1899 | Mellon | 5/152 |

(List continued on next page.)

FOREIGN PATENT DOCUMENTS

| | | | | | |
|---|---|---|---|---|---|
| AT | 41433 | | * | 3/1910 | 5/285 |
| AU | 246440 | | * | 8/1963 | 5/202 |
| CH | 18339 | | * | 1/1899 | 5/152 |
| CH | 42857 | | * | 2/1908 | 5/152 |
| DE | 294769 | | * | 2/1915 | 5/152 |
| DE | 76822 | | * | 6/1918 | 5/152 |
| DE | 1172409 | A | * | 6/1964 | 5/618 |
| DE | 2005710 | A | * | 12/1971 | 5/618 |
| DE | 2740828 | A | * | 3/1979 | 5/616 |
| DE | 2815076 | A | * | 6/1979 | 5/618 |
| DE | 2920666 | A | * | 11/1980 | 5/618 |
| DK | 13785 | | * | 10/1910 | 5/285 |
| FR | 326105 | | * | 2/1903 | 5/152 |
| FR | 449262 | | * | 2/1913 | 5/152 |
| FR | 722797 | | * | 3/1932 | 5/152 |
| FR | 786557 | | * | 9/1935 | 5/152 |
| FR | 1010886 | | * | 6/1952 | 5/152 |
| FR | 1506579 | A | * | 12/1967 | 5/618 |
| GB | 11549 | | * | 9/1886 | 5/152 |
| GB | 188276 | | * | 11/1922 | 5/152 |
| IT | 517239 | B | * | 2/1957 | 5/618 |
| IT | 719633 | B | * | 11/1966 | 5/618 |
| SE | 9162 | | * | 8/1898 | 5/285 |

OTHER PUBLICATIONS

Brochure of Burke Tri–Flex, 2 pages, undated.

Brochure of Camtec: Cambridge Technologies, Inc.: Bariatric Beds, one page, dated Apr. 28, 2000.

Brochure of Camtec: Cambridge Technologies, Inc.: About Us, one page, dated Apr. 28, 2000.

Brochure of ConvaQuip Bariatric Equipment, Bariatric Single Frame Electric Beds, one page, dated Apr. 28, 2000.

Brochure of ConvaQuip Bariatric Equipment, Bariatric Split Frame Electric Beds, one page, dated Apr. 28, 2000.

(List continued on next page.)

*Primary Examiner*—Robert G. Santos

(57) ABSTRACT

A rehabilitation bed for obese persons is provided that has a center frame section with first and second ends. A transport assembly is coupled to the center frame section that has at least one pair of transport wheels depending downwardly from the center frame section. A head base frame is pivotally coupled to the one end of the center frame section and a foot base frame is pivotally coupled to the other end of the center frame section. A patient support surface is coupled to the center frame section, the head base frame, and the foot base frame and is adapted to provide support for a mattress for the bed. The bed may thus be unfolded for use by a person with the head base frame, center frame section and the foot base frame located in substantially the same plane. The head base frame and foot base frame may also be pivoted upwardly relative to the center frame section leaving the transport wheels in contact with the ground so that the bed is easily transportable from room to room.

18 Claims, 5 Drawing Sheets

U.S. PATENT DOCUMENTS

| | | | | | |
|---|---|---|---|---|---|
| 712,599 | A | * | 11/1902 | Sanders | 5/152 |
| 748,847 | A | * | 1/1904 | De Vault | 5/183 |
| 807,909 | A | * | 12/1905 | Braznell | 5/152 |
| 819,435 | A | * | 5/1906 | Jonas | 5/152 |
| 1,110,812 | A | * | 9/1914 | Meadoff | 5/152 |
| 1,420,126 | A | * | 6/1922 | Morfoot | 5/613 |
| 1,458,561 | A | * | 6/1923 | Trompeter | 5/611 |
| 1,474,200 | A | * | 11/1923 | McKellar | 5/152 |
| 1,637,845 | A | * | 8/1927 | Abrams | 5/152 |
| 1,841,648 | A | * | 1/1932 | Sorey | 5/152 |
| 2,572,642 | A | * | 10/1951 | Margiloff | 5/152 |
| 2,582,565 | A | * | 1/1952 | Schnippel et al. | 5/618 X |
| 2,651,787 | A | * | 9/1953 | Piliero | 5/152 |
| 2,666,931 | A | * | 1/1954 | Clerc | 5/181 |
| 2,701,603 | A | * | 2/1955 | Coopersmith | 5/152 |
| 2,773,269 | A | * | 12/1956 | Holt | 5/152 |
| 2,823,391 | A | * | 2/1958 | Fisher et al. | 5/152 |
| 3,003,158 | A | * | 10/1961 | Sevcik | 5/181 |
| 3,300,794 | A | * | 1/1967 | Altorfer | 5/616 |
| 3,456,269 | A | * | 7/1969 | Goodman | 5/620 X |
| 3,739,406 | A | * | 6/1973 | Koetter | 5/618 X |
| 3,744,066 | A | * | 7/1973 | Falivene | 5/200.1 X |
| 3,881,202 | A | * | 5/1975 | Tyhanic | 5/185 X |
| 4,097,939 | A | | 7/1978 | Peck et al. | 5/611 |
| 4,376,317 | A | * | 3/1983 | Johnston | 5/618 X |
| 4,409,695 | A | * | 10/1983 | Johnston et al. | 5/616 X |
| 4,598,434 | A | * | 7/1986 | Mis | 5/200.1 |
| 4,670,922 | A | * | 6/1987 | Mis | 5/200.1 |
| 4,685,160 | A | * | 8/1987 | Rizzardo | 5/620 |
| 4,928,332 | A | * | 5/1990 | Ogden et al. | 5/618 X |
| 5,095,562 | A | | 3/1992 | Alexander | 5/616 |
| 5,257,428 | A | * | 11/1993 | Carroll et al. | 5/620 |
| 5,438,723 | A | | 8/1995 | Carroll | 5/620 |
| 5,669,090 | A | | 9/1997 | Basgall | 5/620 |
| 6,230,344 | B1 | * | 5/2001 | Thompson et al. | 5/611 |
| 6,357,065 | B1 | * | 3/2002 | Adams | 5/618 |

OTHER PUBLICATIONS

U.S. PTO Status Check of mark Tri–Flex Cables, two pages, dated Jan. 12, 1999.

U.S. PTO Status Check of mark Triflex, owned by Uvex Winter Optik GmBH, one page, dated Jan. 12, 1999.

U.S. PTO Status Check of mark Tri–Flex, owned by Uniflex, Inc., one page, dated Jan. 12, 1999.

U.S. PTO Status Check of mark Tri–Flex, owned by Craddock–Terry Shoe Corporation, one page, dated Jan. 12, 1999.

U.S. PTO Status Check of mark Tri–Flex, owned by Worth, Inc., one page, dated Jan. 12, 1999.

U.S. PTO Status Check of mark Tri–Flex, owned by Tri–Seal International, Inc., one page, dated Jan. 12, 1999.

U.S. PTO Status Check of mark TriFlex, Fund owned by Triflex Fund, Inc., one page, dated Jan. 12, 1999.

Brochure of Diamond Acute Care, one page, undated.

Brochure of "Mighty" Rest Rehab Bed, one page, undated.

Brochure of Bariatric Solutions, Wheelchairs of Kansas, vol. 7, No. 2, undated.

Brochure of KCI Home Care, "MAXXIS 300", one page, 1997.

Brochure of KCI Home Care, "MAXXIS 400," one page, 1997.

Brochure of HomeCare Magazine Buyers' Guide, Pinnacle Transport System, one page, 1999/2000.

Brochure of Neurological Research and Development Group, Neuropedic Hi–Lo Rehabilitation Bed, one page, undated.

* cited by examiner

Fig.3.
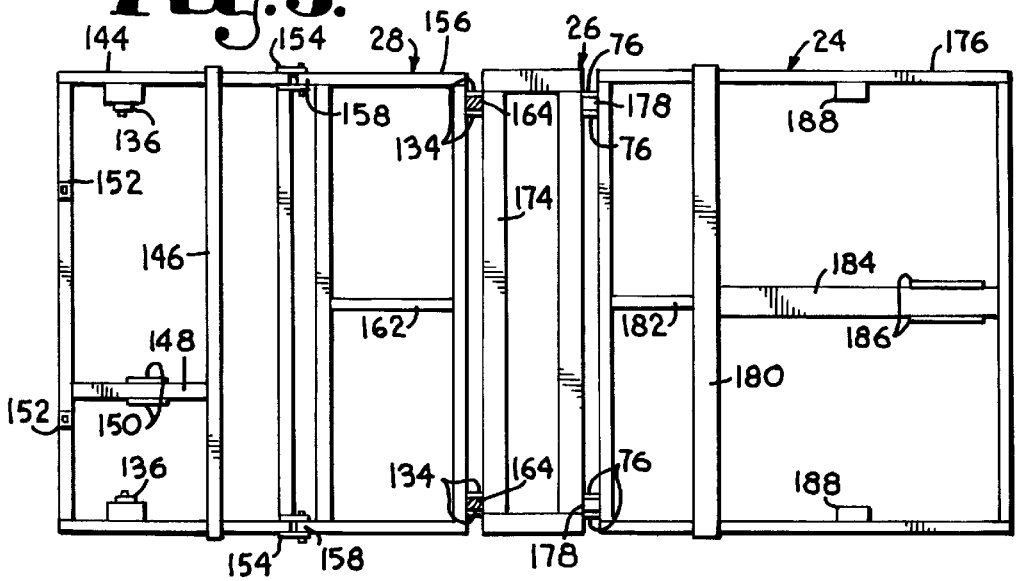
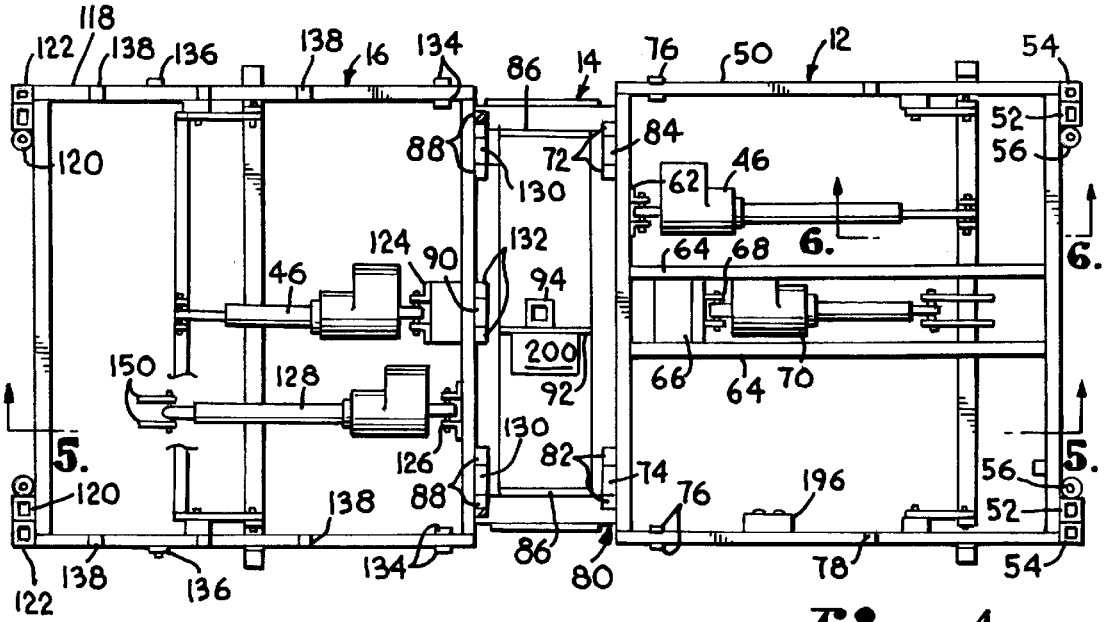
Fig.4.
Fig.5.
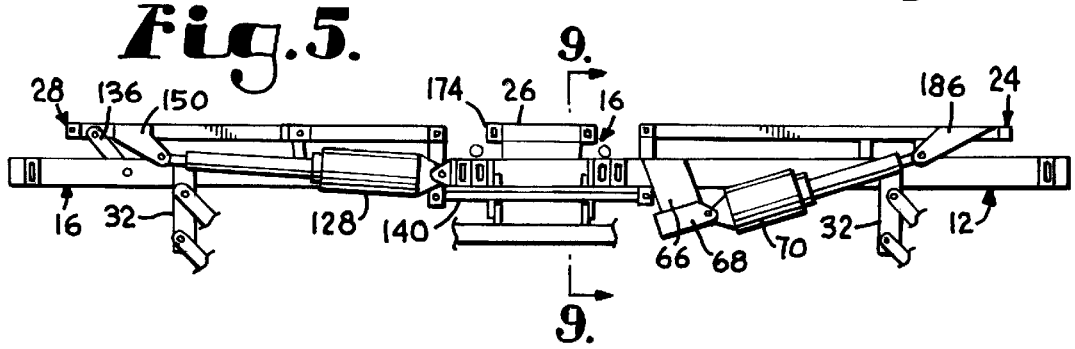

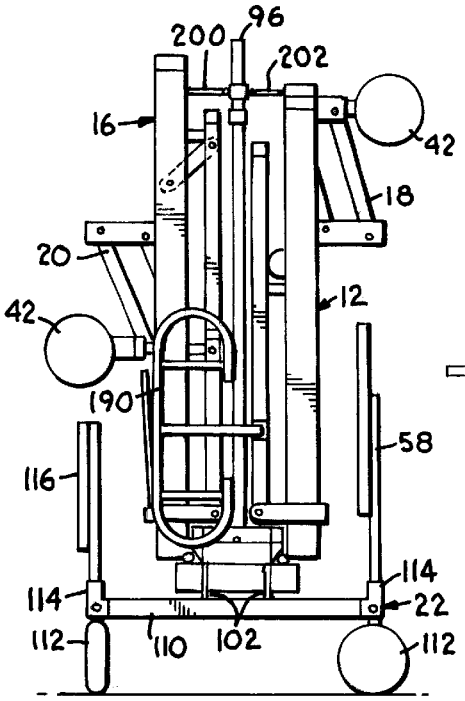
Fig. 11.
Fig. 17.
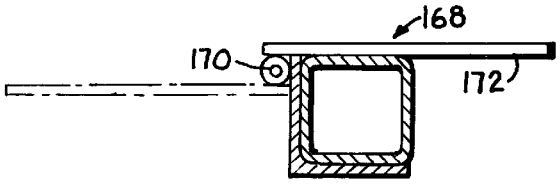
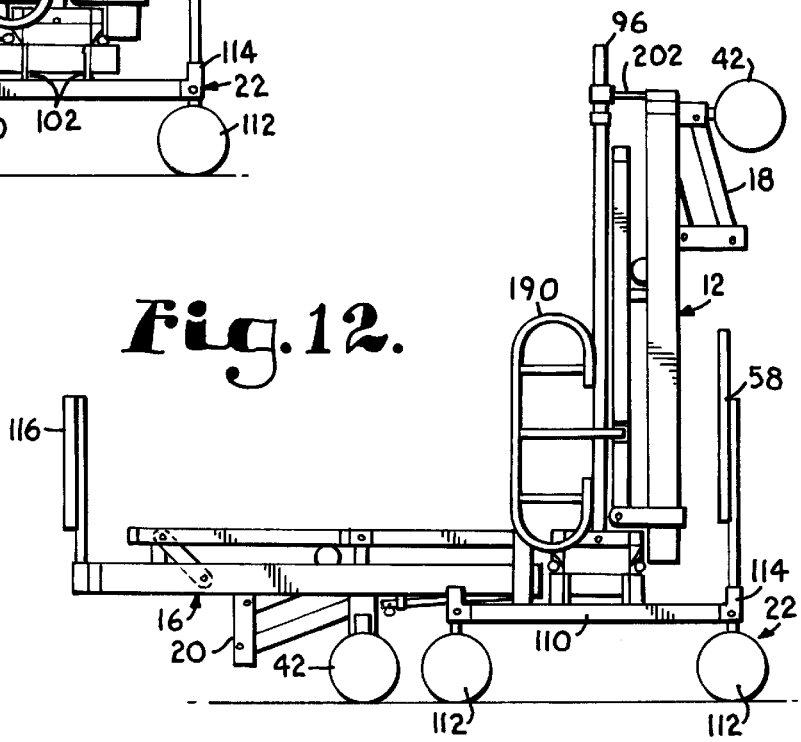
Fig. 12.
Fig. 13.
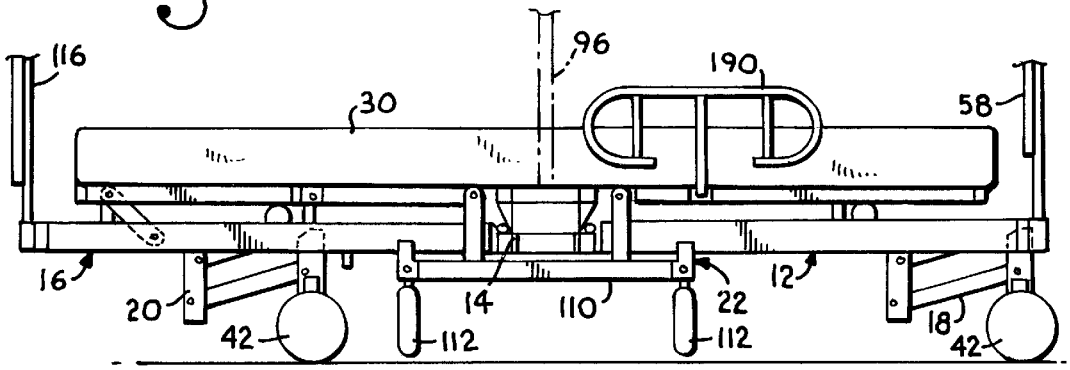

FOLDABLE REHABILITATION BED FOR ACCOMMODATING AN OBESE PERSON

STATEMENT REGARDING FEDERALLY SPONSORED RESEARCH OR DEVELOPMENT

Not Applicable.

CROSS-REFERENCE TO RELATED APPLICATIONS

Not Applicable.

BACKGROUND OF THE INVENTION

This invention relates generally to rehabilitation or bariatric beds that are used to accommodate an obese person. More particularly, the invention relates to a bariatric bed that is foldable into a configuration making it easy to transport.

Overweight people are commonly referred to as being obese. These obese people often require special care, either at home or in a care-giving facility. One of the pieces of equipment frequently used in the care of obese people is a rehabilitation or bariatric bed. These beds are specifically designed to address the special needs required in the care of an obese person. For example, these beds are designed to place the obese person in a variety of positions. Thus, the beds are usually capable of independently and selectively elevating or lowering both the head and foot of the bed, as well as being capable of simultaneously raising or lowering the bed frame relative to the floor. Also, these beds are designed to independently raise the portion of the mattress in the area of the obese person's knee relative to the bed frame and raising the entire head and torso portion of the mattress relative to the bed frame. Such positioning is often necessary to place the obese person in a sitting position.

Rehabilitation beds are often called upon to accommodate persons whose weight may exceed 400 pounds. As a consequence, these rehabilitation beds must be wide enough to accommodate the obese person. Because of their width, the prior art rehabilitation beds are difficult to transport from one room to another. In the past, the prior art beds were disassembled into separate sections before moving the bed into another room. Once at the desired location, the prior art bed would be reassembled. This disassembly and assembly process is a difficult and time consuming process. Often, the process requires two people to properly align the two separate sections of the bed so that they can properly be assembled. The second person is needed because the bed is both heavy and awkward to handle.

Another problem existing with prior art rehabilitation beds relates to their length. The standard prior art rehabilitation bed is designed to accommodate the height of a great majority of obese persons. However, a certain number of obese persons are tall enough so as to be unable to comfortably fit on the standard rehabilitation bed. The prior art beds do not offer a mechanism for increasing the length thereof to accommodate any of these taller obese persons.

Similarly, the width of the standard mattress support frame for a prior art rehabilitation bed will accommodate a mattress wide enough to support a great majority of obese persons. However, there are some obese persons that are large enough that the standard width mattress will not comfortably provide support. In these instances, it would be desirable to provide a rehabilitation bed with a mattress support frame capable of selectively providing support for a wider mattress. The process of adding width to the mattress support frame needs to be as simple and quick as possible so that the change in mattress width is easily accomplished.

Yet another problem associated with existing prior art beds relates to the way in which the bed is elevated and lowered. Some prior art beds tend to move in a "caterpillar"action away from the wall and into the middle of the room. It is preferable, as would be understood, for the bed to remain in one position during its use.

Therefore, a rehabilitation bed for accommodating an obese person is needed that overcomes the above drawbacks and disadvantages existing in the prior art.

SUMMARY OF THE INVENTION

It is therefore an object of the present invention to provide a rehabilitation bed for accommodating an obese person that does not need to be disassembled for the transportation thereof.

It is another object of the present invention to provide a rehabilitation bed for accommodating an obese person with an assembly that can be folded into a relatively narrow construction for transport from one room to another.

Still another object of the present invention is to provide a rehabilitation bed for accommodating an obese person with a mechanism that allows the overall length of the bed to be selectively increased to accommodate taller persons.

It is yet another object of the present invention to provide a rehabilitation bed for accommodating an obese person that employs a relatively simple mechanism which allows for a wider mattress support frame to accommodate different widths of mattresses.

To accomplish these and other related objects, a rehabilitation bed for accommodating an obese person is provided. The bed has a center frame section with first and second ends. A transport assembly is coupled to the center frame section that has at least one pair of transport wheels depending downwardly from the center frame section. A head base frame is pivotally coupled to the one end of the center frame section and a foot base frame is pivotally coupled to the other end of the center frame section. A patient support surface is coupled to the center frame section, the head base frame and the foot base frame that is adapted to provide support for a mattress for the bed. The bed may thus be unfolded for use by a person with the head base frame, center frame section and the foot base frame located in substantially the same plane. The head base frame and foot base frame may also be pivoted upwardly relative to the center frame section leaving the transport wheels in contact with the ground so that the bed is easily transportable from room to room.

Additional objects, advantages, and novel features of the invention will be set forth in part in the description which follows, and in part will become apparent to those skilled in the art upon examination of the following, or may be learned from practice of the invention.

BRIEF DESCRIPTION OF THE DRAWINGS

In the accompanying drawings which form a part of the specification and which are to be read in conjunction therewith and in which like reference numerals are used to indicate like parts in the various views:

FIG. 3 is a top plan view of the patient support frame of the rehabilitation bed of FIG. 1;

FIG. 4 is a top plan view of the base frame of the rehabilitation bed of FIG. 1;

FIG. 5 is a partial cross-sectional view taken along line 5—5 of FIG. 4;

FIG. 11 is a side elevation view of the rehabilitation bed of FIG. 1, shown in a folded condition without the mattress;

FIG. 12 is a side elevation view similar to FIG. 11, showing the rehabilitation bed in a partially unfolded state;

FIG. 13 is a view similar to FIG. 12, showing the rehabilitation bed in an unfolded condition;

FIG. 17 is a partial cross-sectional view taken along line 17—17 of FIG. 2, showing the frame extensions of the rehabilitation bed of FIG. 1.

DETAILED DESCRIPTION OF THE PREFERRED EMBODIMENT

Figure 1:
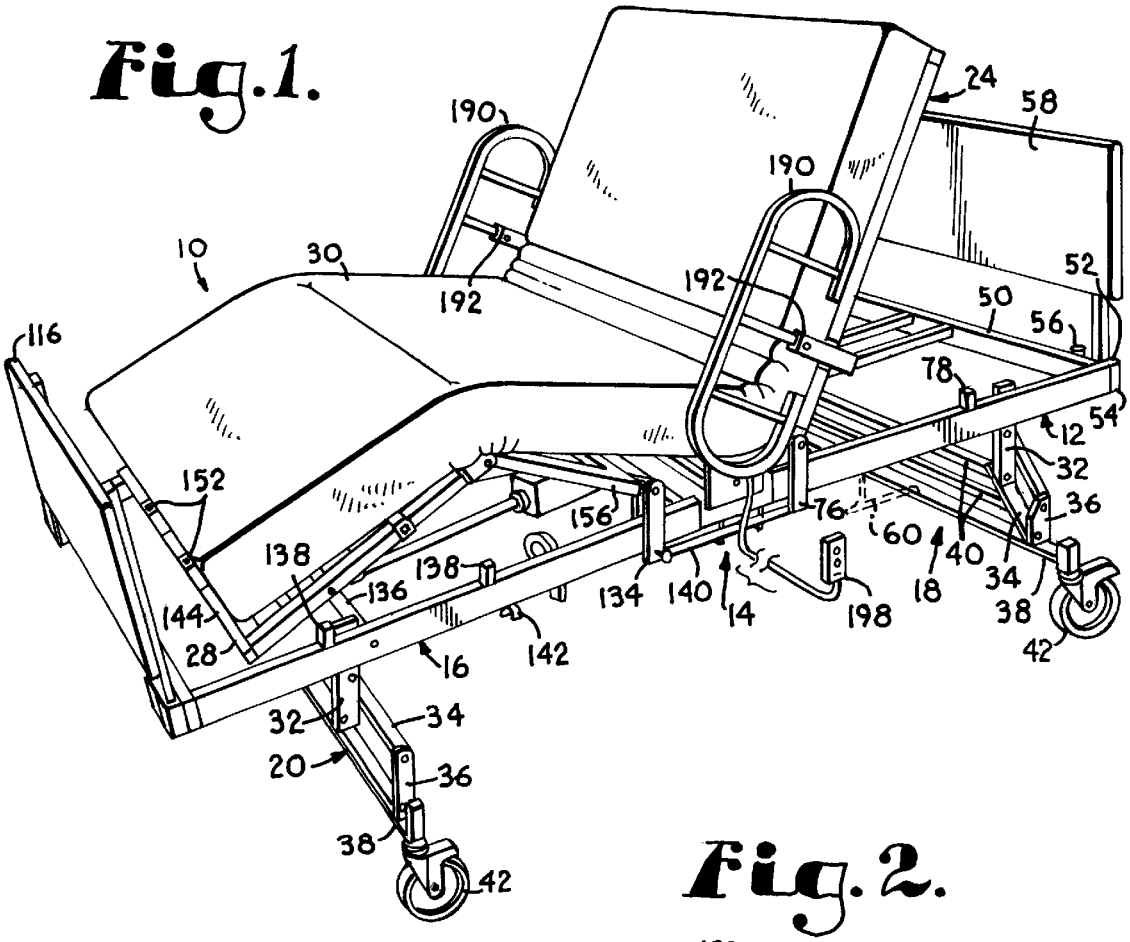
FIG. 1 is a perspective view of a rehabilitation bed according to the present invention.
Figure 14:
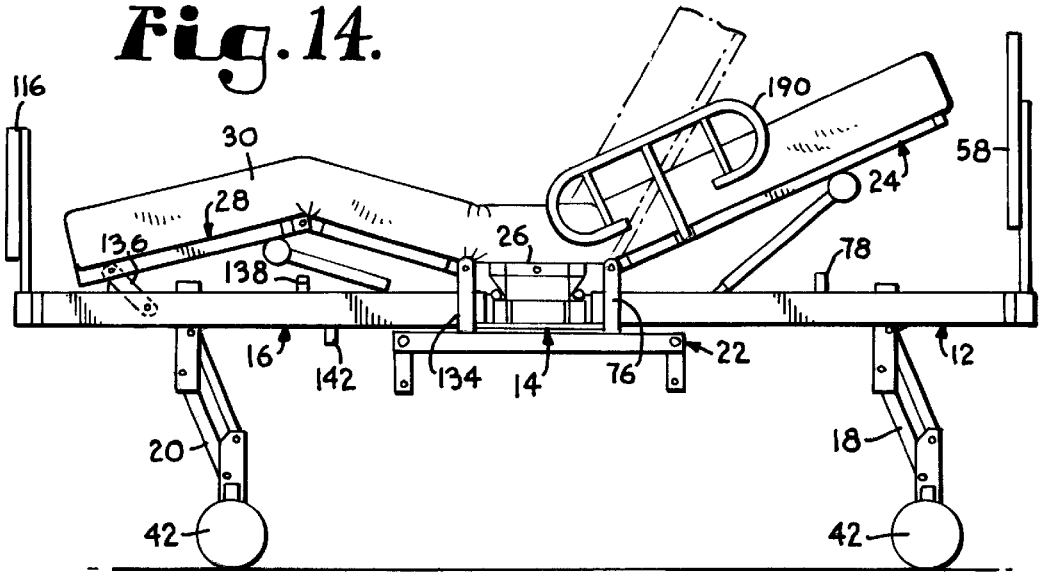
FIG. 14 is a side elevation view similar to FIG. 13, showing the base frame of the rehabilitation bed in an elevated condition and showing a different positioning for the mattress thereon.
Figure 15:
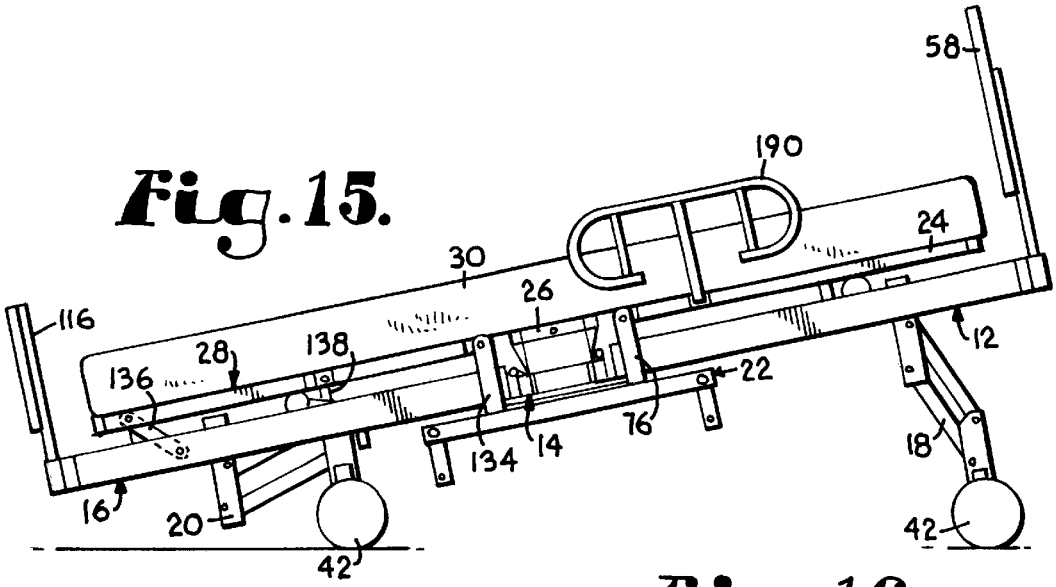
FIG. 15 is a view similar to FIG. 14, showing a different positioning with the foot of the bed being lowered relative to the head of the bed.
Figure 16:
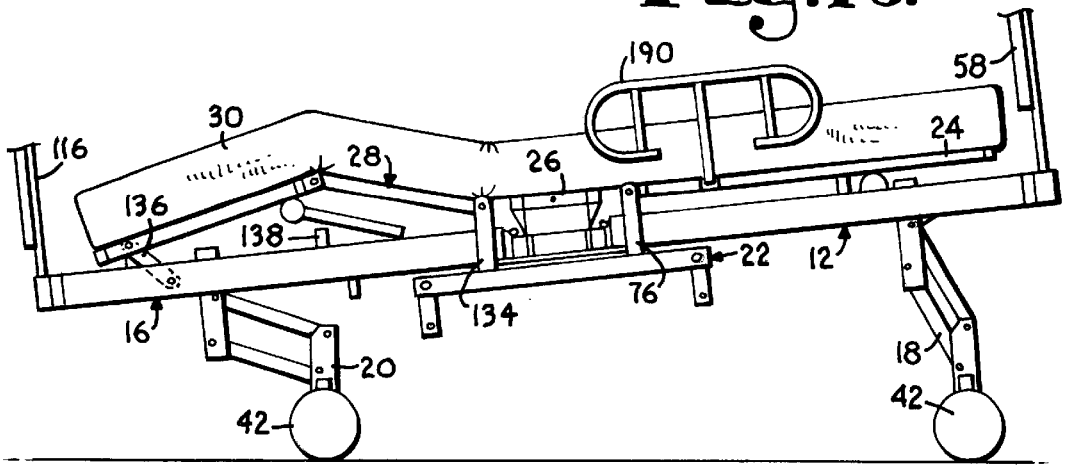
FIG. 16 is a partial side elevation view similar to FIG. 15, showing yet another position for the rehabilitation bed.

Referring now to the drawings in greater detail, and initially to FIG. 1, a rehabilitation bed for accommodating an obese person is represented by the reference numeral 10. Bed 10 includes a head base frame 12, a center base frame 14 and a foot base frame 16. As is more fully discussed below, frames 12 and 16 are hingedly coupled to frame 14 allowing bed 10 to be easily transported when not in use. Extending below and coupled to frame 12 is a head high-low linkage 18. Similarly, extending below and attached to frame 16 is a foot high-low linkage 20. Linkages 18 and 20 are used to selectively elevate and lower portions of bed 10 to place the bed in varying positions, as is further discussed below. As best seen in FIGS. 11 through 16, bed 10 further includes a transport assembly 22. Assembly 22 can be selectively retracted and lowered. When the bed 10 is in a folded orientation as seen in FIG. 11, assembly 22 is lowered to support bed 10 for transport. When bed 10 is in use, assembly 22 is retracted as seen in FIGS. 14 through 16 to move assembly 22 out of the way.

As best seen FIG. 5, suspended above frame 12 and pivotally coupled thereto is a head patient support 24. A center patient support 26 is suspended above frame 14 and a foot patient support 28 is pivotally suspended above frame 16. Supports 24, 26 and 28 provide support for a mattress 30 as is shown in FIG. 1. Moreover, as is more fully described below, supports 24, 26 and 28 operate to place the mattress and the patient in different desired orientations. A more detailed description of each of the major components described above is set forth below.

Figure 6:
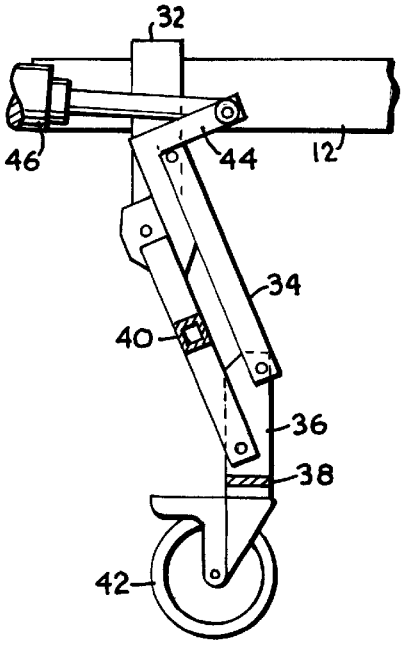
FIG. 6 is an enlarged, partial cross-sectional view taken along line 6—6 of FIG. 4.
Figure 7:
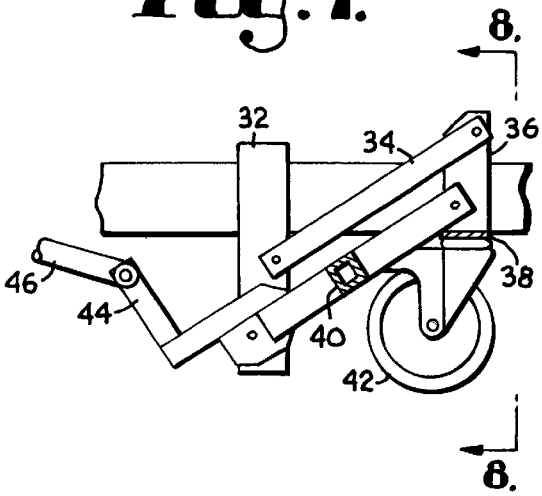
FIG. 7 is a view similar to FIG. 6, showing the transport wheels in a different position.

As best seen in FIGS. 1 and 6 through 7, linkage 18 includes a pair of linkage support bars 32 that are rigidly secured to frame 12. One bar 32 is coupled to each side of frame 12. As best seen in FIGS. 6 and 7, a parallel linkage 34 is pivotally coupled to each bar 32. Linkage 34 includes a pair of spaced extending members that are pivotally coupled on one end to bar 32 and that are pivotally coupled on their opposite ends to a plate 36. Plate 36 is rigidly secured to a horizontal connecting bar 38. Bar 38 connects plates 36 to one another and is best seen in FIGS. 1 and 4. Additional horizontal support bars 40 may be provided to add stability to linkage 18 as is shown in FIG. 1. Bar 38 has a caster 42 rigidly secured on each outer end thereof. Preferably, casters 42 are swivel casters which can be locked when desired. As best seen in FIGS. 4 and 6 through 7, the upper-most support bar 40 has an actuator connecting member 44 rigidly secured thereto. The outer end of member 44 is pivotally coupled to a high-low actuator 46. As is more fully described below, the opposite end of actuator 46 is pivotally secured to frame 12. Actuator 46 is used to raise and lower frame 12 with respect to the ground.

Figure 8:
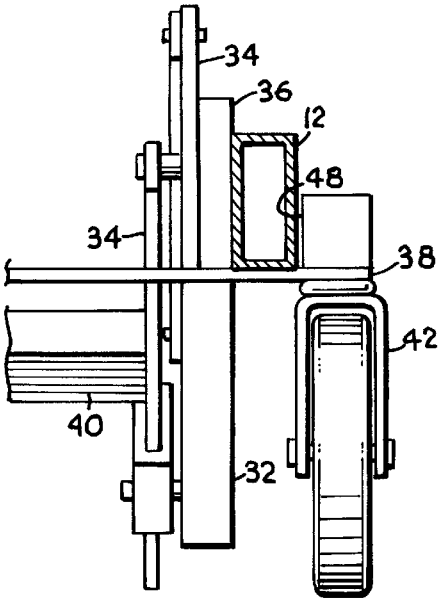
FIG. 8 is an enlarged, partial cross-sectional view taken along line 8—8 of FIG. 7.

Linkage 20 is similarly constructed to linkage 18 with like parts being numbered accordingly. Linkage support bar 32 is, however, rigidly secured to frame 16 and extends below the foot of bed 10. Also, actuator 46 of linkage 20 is pivotally coupled to frame 16, rather than frame 12. As best seen in FIG. 8, linkages 18 and 20 are constructed with a frame gap 48 therein. Gap 48 allows the linkages to fully retract such that the outer frame members of frames 12 and 16 rest on bar 38.

Turning now to FIGS. 1 and 4, head base frame 12 includes a rigid outer support frame 50. Preferably, frame 50 is constructed of welded steel tubing. It should be understood, however, that other rigid frame constructions could be used. Coupled along the outer edge of frame 50 are a pair of headboard supports 52, a pair of patient sling supports 54, and a pair of medical equipment supports 56. Preferably, each of these supports welded to frame 50. As best seen in FIG. 1, supports 52 are utilized to hold and support a removal headboard 58. While not shown, supports 54 may be utilized to hold a patient sling which is often used in the care of obese persons. Further, medical equipment supports 56 may be used to hold such things as an IV support or other timed release dispensers. As best seen in FIG. 1, in phantom lines, an electrical cord bracket 60 is secured to support frame 50 and is used to position the electrical cords associated with bed 10. Turning back to FIG. 4, an actuator fork 62 is welded to the interior of frame 50. Preferably, fork 62 includes a pair of members spaced to accommodate the rearward end of actuator 46. As seen in FIG. 4, actuator 46 as a rearwardly extending tongue that fits within fork 62 and which is pivotally coupled thereto with a retaining pin.

Disposed within the interior of frame 50 are a pair of support bars 64. Preferably, bars 64 are welded to frame 50 and provide additional stability to the frame. Bars 64 also provide support for an actuator frame 66. As best seen in FIG. 5, frame 66 extends below frame 50. Preferably, frame 66 is angled towards the head of bed 10. Rigidly coupled to frame 66 are a pair of spaced arms that form an actuator fork 68. A patient support actuator 70 is pivotally coupled between the members of fork 68, as is seen in FIGS. 4 and 5. Actuator 70 is used to position support 24 upwardly and downwardly, as is more fully described below.

Extending rearwardly from frame 50 is a pair of spaced hinge elements 82 and a central hinge element 84.

Preferably, hinges 82 and 84 are welded to frame 50. Moreover, each hinge element 82 and 84 has a hole extending therethrough. Each of these holes is in alignment with the other holes. Hinges 82 and 84 are used to pivotally couple frame 12 to frame 14, as is more fully described below.

As best seen in FIGS. 1 and 4, frame 50 also has a pair of patient support brackets 76 rigidly coupled on each side thereof generally adjacent the center-most portion of the frame 50. Brackets 76 are used to pivotally couple support 24 to frame 12. Preferably, brackets 76 are welded to frame 50. It should be understood, however, that other means of attachment or brackets 76 could be utilized. Frame 50 also has a pair of upwardly extending patient support stops 78 rigidly secured thereto. Stops 78 allow patient support 24 to rest thereon when the patient support is in a fully lowered condition.

As best seen in FIG. 4, center frame 14 is pivotally coupled to head frame 12. More specifically, center frame 14 has a generally rectangular outer support frame 80. Frame 80 is preferably made of welded steel tubing and has a pair of spaced hinge elements 72 rigidly secured to the upper surface thereof. Preferably, elements 72 are welded to frame 80. Hinges 72 are spaced to allow central hinge 84 of frame 12 to be disposed there between. Similarly, a central hinge 84 is welded to the top surface of frame 50 and is positioned to be aligned between hinge elements 72 of frame 14. When hinge 74 is aligned with hinges 82 and hinge 84 is aligned between hinges 72, a pin is placed through the hinges, thereby pivotally coupling head base frame 12 to center base frame 14. Rigidly secured to each side of frame 80 is a side panel 86. Preferably, panels 86 are welded directly to frame 80. As is more fully described below, panels 86 are used to couple center support 26 to center frame 14. Two sets of spaced hinge elements 130 are welded to the top surface of frame 80 generally adjacent foot base frame 16. Hinges 130 are preferably circular and have a hole extending therethrough. Located generally midway between hinges 130 is a center hinge element 90 and a pair of hinge elements 132. Hinge 90 is also circular with a hole therethrough. The holes in hinge elements 132 are aligned with the hole in hinge 90. As best seen in FIG. 4, a bridging plate 92 is rigidly secured between the longer members of frame 80 generally midway along the length thereof. Plate 92 is used to support a piece of square tubing 94. Preferably, tubing 94 is welded to plate 92. Tubing 94 provides support for a transport tube 96, as is best seen FIGS. 11 and 12. Tube 96 is sized to fit securely within tubing 94 and provides support for both the head portion and foot portion of bed 10 when bed 10 is in a folded orientation as is seen in FIG. 11.

Figure 9:
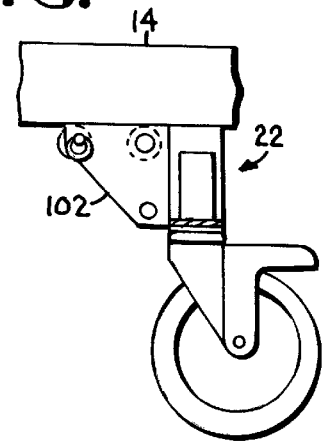
FIG. 9 is a partial cross-sectional view taken along line 9—9 of FIG. 5.
Figure 10:
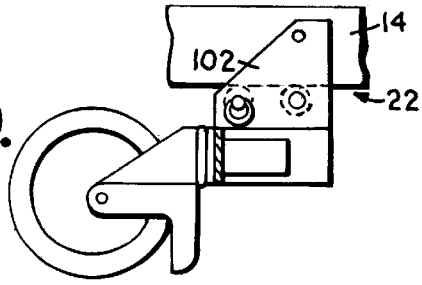
FIG. 10 is view similar to FIG. 9, showing the transport wheels in a different position.

As best seen in FIGS. 9 through 16, the transport assembly 22 of bed 10 includes a pair of spaced brackets 102 that are pivotally connected to frame 14 by a pivot pin 104. When bed 10 is in a folded position and transport assembly 22 is in a lowered condition, a pin is placed through a connecting hole in bracket 102 as is shown in FIG. 9. When transport assembly 22 is rotated upwardly as is shown in FIGS. 14 through 16, brackets 102 are rotated about pivot pin 104 and are held in a retracted position by again placing a pin through the other hole in bracket 102, as shown in FIG. 10. It can therefore be seen that transport assembly 22 may be selectively lowered and pinned in place when bed 10 is desired to be folded into a more compact orientation, such as that shown in FIG. 11. Further, when bed 10 is in use, it is possible to retract transport assembly 22 and hold it conveniently out of the way. As can be seen in FIG. 11, a horizontal member 110 is rigidly secured to brackets 102 that extends outwardly beyond frames 12 and 16 when they are in a folded condition. Each outer end of member 110 has a locking swivel caster 112 secured thereto. Extending upwardly from each outer end of member 110 is a board support 114. As is more fully described below, board supports 114 are shaped to receive head board 58 and a foot board 116 when bed 10 is in the folded condition shown in FIG. 11. Supports 114 therefore provide a convenient storage mechanism for foot board 116 and head board 58 when they are not in use.

As best seen in FIG. 4 and as briefly discussed above, center frame 14 has foot base frame 16 hingedly coupled thereto. Frame 16 includes an outer support frame 118 preferably constructed of welded steel tubing. A pair of spaced square tubing foot board supports 120 are welded to frame 118. Supports 120 receive foot board 116 and hold board 116 in place when bed 10 is being used. Immediately adjacent support 120 is a sling support 122. Like patient sling support 54, support 122 may receive a patient sling, as is known to those of skill in the art. As best seen in FIG. 4, an actuator fork 124 is welded to the inner perimeter of frame 118 generally adjacent to center frame 14 and approximately midway there along. Fork 124 is preferably constructed of a pair of spaced angle iron pieces which are welded to frame 118. Fork 124 accommodates the rearward-most end of high-low actuator 46 and pivotally couples actuator 46 to frame 118. A second actuator fork 126 is located adjacent fork 124, and is similarly constructed. Fork 126 pivotally receives a patient support actuator 128 which is used to selectively raise and lower foot patient support 28, as is more fully described below.

A pair central hinge elements 88 is welded to the outside of frame 118. Each hinge element 88 is located to align with spaced hinge elements 130 of the center frame 14. A generally centrally disposed pair of spaced hinge elements 132 is also welded to frame 118. Hinges 132 are located so as to generally align with central hinge 90 of center base frame 14. When hinge elements 88, 90, 130 and 132 are in alignment, a pin is placed through each hinge assembly to pivotally couple center frame 14 to foot base frame 16. As best seen in FIGS. 1 and 4, a pair of upper leg support brackets 134 is secured to each end of frame 118 near center frame 14. Each bracket 134 has a hole disposed through its upper end which is used to pivotally connect foot support 28 to foot base frame 16. A pair of lower leg links 136 are pivotally coupled to inner frame 118 near the high-low linkage 20. Each link 136 extends between frame 118 and foot support 28, as is more fully described below. As best seen in FIG. 1, a series of patient stops 138 are welded to the top of frame 118. Stops 138 abut foot patient support 28 when it is in a fully lowered condition and act to provide additional support therefore.

When bed 10 is being used, it is necessary to employ an anti-pivot locking bar 140. Bar 140 extends between brackets 134 on foot frame 16 and brackets 76 of head frame 12. Bar 140 prevents frames 12 and 16 from pivoting relative to center frame 14 when bed 10 is in use. Bar 140 is thus removably securable between brackets 134 and 76. When bar 140 is not in use, such as in the folded orientation shown in FIG. 11, a spring clip 142 is used to hold bar 140 out of the way. Clip 142 is secured to outer support frame 118. It should be understood that other mechanisms for removably holding bar 140 could be used.

As best seen in FIG. 1, foot patient support 28 is suspended above frame 118 of foot base 16. Foot support 28 includes a lower leg frame 144 which is pivotally coupled to lower leg links 136. As best seen in FIG. 3, frame 144 is reinforced with a piece of welded steel tubing 146. Tubing 146 also provides support for an actuator suspension arm 148 that extends between frame 144 and tubing 146. As best seen FIG. 5, a pair of pivot plates 150 are rigidly secured to arm 148 and extend downwardly therefrom. Plates 150 are used to pivotally connect the outward end of actuator 128, as is best seen in FIGS. 4 and 5. As best seen in FIG. 1, frame 144 has a pair of upwardly extending mattress stays 152 welded to the lower end thereof. Stays 152 operate to maintain the proper position of mattress 30 on bed 10. As best seen in FIG. 3, extending outwardly from the end of frame 144 opposite stays 152 are a pair of connecting forks 154. Forks 154 are used to connect frame 144 to an upper leg frame 156.

As best seen in FIG. 3, frame 156 has a pair of rearwardly extending arms 158 that are received within forks 154. After arms 158 are disposed within forks 154 they are pinned in place with a pivot pin which allows frame 144 to pivot with respect to frame 156. To add additional support to frame 156, a center bar 162 is welded thereto. As best seen in FIGS. 1 and 3, frame 156 has a pair of pivot legs 164 welded thereto and extending towards the center of bed 10. Legs 164 are pivotally coupled to support brackets 134. Each leg 164 extends between the associated pair of brackets 134 and is pinned in place. This connection allows frame 156 to pivot upwardly with respect to foot base frame 16.

Figure 2:
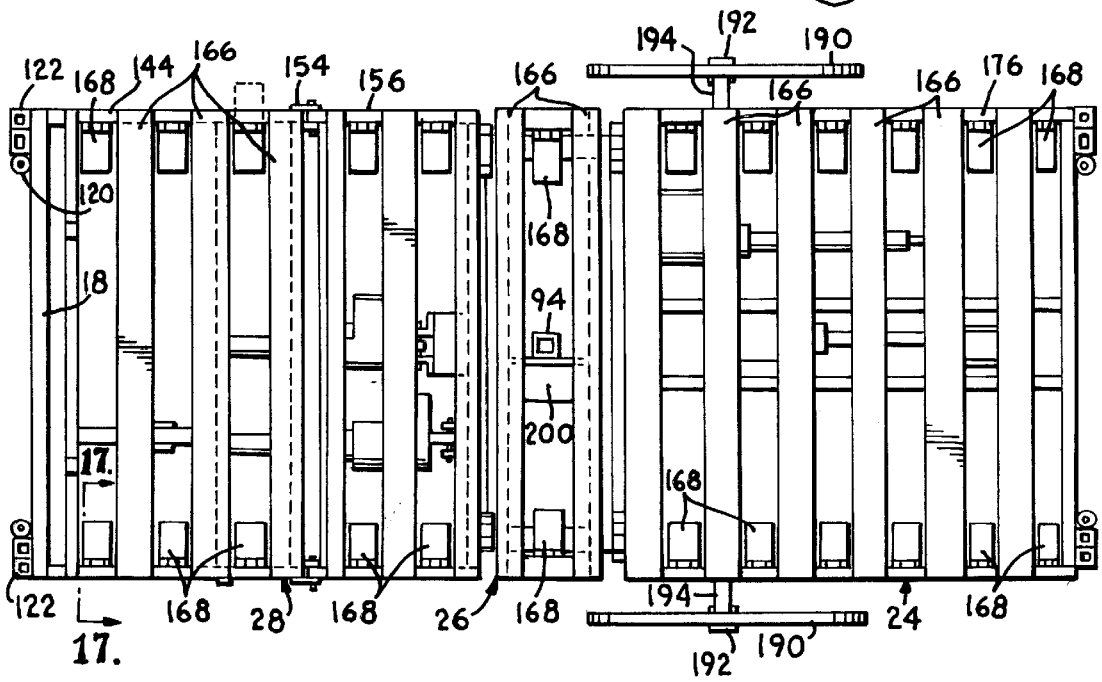
FIG. 2 is a top plan view of the rehabilitation bed of FIG. 1, shown without the mattress and with the patient support frame in a lowered, horizontal position.

As best seen in FIG. 2, a series of mattress support plates 166 are welded to the top surfaces of frames 144 and 156. Plates 166 provide the support surface for mattress 30. As best seen in FIGS. 2 and 17, located in the spaces between plates 166 are a series of frame extensions 168. Extensions 168 are pivotally secured to the corresponding frame 144 or 156 and operate to extend the associated frame width if a wider mattress 30 is to be used. As best seen in FIG. 17, each extension 168 has a hinge element 170 and a flip plate 172. Hinges 170 operate to pivotally couple plates 172 so that they may be pivoted inwardly as is shown in FIG. 2 when a standard mattress is to be used. If a wider mattress is to be used plates 172 may be pivoted so that they extend outwardly as shown in phantom lines in FIG. 17.

As best seen in FIGS. 2,3 and 5, center patient support 26 includes a rectangular frame 174 which is suspended above center base frame 14 by side panels 86. Frame 174 also includes mattress support plates 166 and frame extensions 168 as were described above for foot patient support 28, as best seen in FIG. 2. Only one center frame 14 and center patient support 26 are described and shown. It should be understood, however, that a second center frame 14 and center patient support 26 could be utilized in connection with bed 10 that has a different length. The provision of a longer center frame 14 and center patient support 26 allows bed 10 to be converted into a bed having a longer overall length, such as may be needed by unusually tall persons.

As best seen in FIGS. 1, 2 and 3, head patient support 24 is pivotally coupled above base frame 12. Support 24 includes an outer support frame 176, which is preferably constructed of welded steel tubing. Frame 176 includes a pair of spaced pivot legs 178 which are pivotally connected to patient support brackets 76. This connection allows support 24 to pivot with respect to frame 12 as is shown in FIG. 1. A horizontal reinforcing member 180 is welded to frame 176, as is seen in FIG. 3. Welded perpendicularly to member 180 are reinforcing bars 182 and 184. The bars 182 and 184 add further structural support to frame 176. As best seen in FIGS. 3 and 4, a pair of spaced actuator support plates 186 are rigidly secured to bar 184 and extend downwardly therefrom. Plates 186 are used to pivotally connect the outward end of actuator 70 to frame 176 to allow movement of frame 176 with respect to frame 12. The actual connections of the actuators are shown in FIGS. 4 and 5. It should be noted, however, that the actuator connections in FIGS. 11 through 16 are shown schematically by a circle. Frame 176 is also provided with a pair of support stops 188. Preferably, stops 188 are welded to the inside of frame 176 and are positioned to rest upon patient support stop 178 of frame 12. As best seen in FIGS. 1 and 2, frame 176 is also provided with a pair of side rails 190. Rails 190 are equipped with both a height adjustment tube 192 and a width adjustment tube 194. Tubes 192 and 194 are used to properly position side rails 190. In operation, rails 190 are telescopingly received within tube 192. Similarly, the lower end of height adjustment tube 192 is L-shaped and is telescopingly received within width adjustment tube 194. Once properly positioned, side rails 190 may be secured in place with any suitable mechanism, such as a retaining pin or a threaded retaining knob as would be understood by those of skill in the art.

In use, the above-described bed 10 may be utilized to support and position an obese person. Bed 10 is constructed to allow the obese person to be placed in a variety of positions. For example, foot patient support 28 can be moved from a flat position, such as that shown in FIG. 13, to a position elevating the person's knees as is shown in FIG. 1, by engaging actuator 128. This engagement acts upon pivot plates 150 of lower leg frame 144 to move the lower most end of frame 144 towards the center of bed 10. Lower leg links 136 pivotally couple frame 144 above frame 16 and allow lower leg frame 144 of foot patient support 28 to move into the upwardly angled position shown in FIG. 1. As lower leg frame 144 moves, upper leg frame 156 will be angled in the reverse direction, as shown in FIG. 1, due to the pivotal connection of frame 156 to frame 144. Similarly, support frame 176 for head patient support 24 may be moved into an inclined position as is shown in FIG. 1 through the use of actuator 70. As actuator 70 is extended, the force will act upon actuator support plates 186, and, because frame 176 is fixed at its lower end through patient support brackets 76 to frame 12, the upper end of frame 12 will move into an angled position as shown in FIG. 1.

Similarly, bed 10 may be placed in different angled positions through the use of high-low linkages 18 and 20. High-low actuators 46 are used for this purpose. By engaging actuators 46, linkages 18 and 20 may be extended to elevate bed 10 as is shown in FIG. 14. Conversely, linkages 18 and 20 may be retracted to lower bed 10 as is shown in FIG. 13. Moreover, through the use of a switch 196, as seen in FIG. 4, one high-low actuator 46 may be engaged while the other is not. This allows bed 10 to be placed in the position as is shown in FIG. 15 with head high-low linkage 18 extended and foot high-low linkage retracted. It should be understood that the reverse position could be obtained through the operation of switch 196. In operation, switch 196 merely shuts off one actuator 46 while allowing the other to continue operation.

Bed 10 has been described above without reference to any weigh-scales thereon. Prior art rehabilitation beds utilize weigh-scales to determine the weight of persons using the bed, as well as the overall load being placed on the bed. It should be understood that bed 10 may be provided with weigh-scales. The addition of these weigh-scales would be understood by one of skill in the art.

All of the actuators discussed are controlled through a hand held controller 198, as would be understood by those skilled in the art. Moreover, all of the actuators are preferably electrically operated with the power coming from a wall mounted electrical outlet. However, a battery backup 200 may be provided, as shown in FIG. 4, in the event electrical power is not available or is interrupted. While electrical actuators are described above and shown in the Figures, it should be understood that other mechanisms could be used to manipulate bed 10.

The construction described above also allows bed 10 to be placed in an easily transported position as is shown in FIG. 11. To orient bed 10 in the position shown in FIG. 11, the mattress 30 is first moved to a fully lowered condition, such as shown in FIG. 13. Thereafter, the transport assembly 22 is moved from the retracted state shown in FIG. 10 to the extended state shown in FIG. 9. Bed 10 is then moved to a fully lowered condition by retracting linkages 18 and 20 to the fully retracted state shown in FIGS. 7, 8 and 13. Casters 42 are then locked in placed to prevent movement thereof. Next, foot board 116 and head board 58 are removed and set aside. Likewise, mattress 30 is removed from bed 10 and set aside. With mattress 30 out of the way, transport tube 96 is placed within square tubing 94 in center base frame 14. Anti-pivot locking bar 140 is removed from engagement between frames 12 and 16 and is secured out of the way with spring clip 142. Head base frame 12 can then be rotated upwardly with respect to center base frame 14 as is shown in FIG. 12. Once in the fully upright position, a retaining clip 202 is placed over transport tube 96 that engages frame 12 to hold it in the upright position. With frame 12 in the upright position, head board 58 may be placed within board supports 114 of the transport assembly 22. Similarly, foot base frame 16 may be rotated upwardly with respect to center base frame 14 as is shown in FIG. 11. Once frame 16 is in the fully upright position, a retaining clip 200 is placed over transport tube 96 to engage frame 16 and hold it securely in the upright position. Thereafter, foot board 116 may be placed in board supports 114 of the transport assembly. In this orientation, the casters may be unlocked and bed 10 may be moved to a new location. The operation described above can easily be performed by one person, and does not require the alignment of any two pieces for assembly or disassembly.

From the foregoing, it will be seen that this invention is one well adapted to attain all of the ends and objects herein above set forth, together with other advantages which are inherent to the structure. It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings to be interpreted as illustrative and not in a limiting sense.

Having thus described the invention, the following is claimed:

1. A rehabilitation bed for obese persons, comprising:

a first center frame section having first and second ends;

a transport assembly coupled to said center frame section, said assembly having at least one pair of transport wheels depending downwardly from said center frame section;

a head base frame pivotally coupled to said first end of said center frame section and extending outwardly away therefrom;

a foot base frame pivotally coupled to said second end of said center frame section and extending outwardly therefrom in a direction opposite of said head base frame;

a patient support surface coupled to said center frame section, said head base frame and said foot base frame, said patient support surface being adapted to provide support for a mattress for the bed, wherein the bed may be unfolded for use by a person with said head base frame, center frame section and said foot base frame located in substantially the same plane, and wherein said head base frame and said foot base frame may be pivoted upwardly relative to said center frame section leaving said transport wheels in contact with the ground so that the bed is easily transportable from room to room; and a first high-low linkage assembly coupled to said head base frame and a second high-low linkage assembly coupled to said foot base frame, said first and second high-low linkages each being coupled to a high-low actuator adapted to manipulate said linkages to raise and lower the bed.

2. The rehabilitation bed of claim 1, further comprising an anti-pivot bar adapted to be secured across said center frame section between said head base frame and said foot base frame when said bed is unfolded for use by a person, said anti-pivot bar preventing said foot base frame and said head base frame from pivoting with respect to said center frame section.

3. The rehabilitation bed of claim 2, further comprising a tube support coupled to said center frame section and a transport tube adapted to be removably received within said tube support, said transport tube being used when the bed is in a folded condition to provide support for the folded head base frame and foot base frame.

4. The rehabilitation bed of claim 3, further comprising a series of frame extensions pivotally coupled to at least said head base frame and said foot base frame, said extensions being pivotal between a first, inward position when a narrower mattress is used for the bed and a second outward position when a wider mattress is used for the bed, said extensions being easily moved between said first and second positions.

5. The rehabilitation bed of claim 4, wherein said transport assembly is pivotally coupled to said center frame section and wherein said transport assembly is pivotal between a first position with said transport wheels extended and depending downwardly from said center frame section and a second position with said transport wheels retracted and generally adjacent said center frame section.

6. The rehabilitation bed of claim 5, wherein said patient support surface includes:

a center patient support spaced above and coupled to said center frame section;

a head patient support spaced above and pivotally coupled to said head base frame; and a foot patient support spaced above and pivotally coupled to said foot base frame, wherein said head and foot patient supports are independently manipulable into a number of positions.

7. The rehabilitation bed of claim 6, further comprising a first patient support actuator coupled to said foot patient support and a second patient support actuator coupled to said head patient support, said patient support actuators adapted to move said foot patient support and said head patient supports into a number of positions.

8. The rehabilitation bed of claim 7, further comprising a second center frame section having a length different from said first center frame section, said second center frame section adapted to replace said first center frame section when a bed having a greater length is needed.

9. The rehabilitation bed of claim 7, further comprising a removable head board adapted to be coupled to said head base frame when said bed is in an unfolded condition and adapted to be coupled to said transport assembly when said bed is in a folded condition.

10. The rehabilitation bed of claim 9, further comprising a removable foot board adapted to be coupled to said foot base frame when said bed is in an unfolded condition and adapted to be coupled to said transport assembly when said bed is in a folded condition.

11. An easily transportable rehabilitation bed, comprising:

a center frame section having first and second ends;

at least one pair of transport wheels depending downwardly from said center frame section;

a head base frame pivotally coupled to said first end of said center frame section and extending outwardly away therefrom;

a foot base frame pivotally coupled to said second end of said center frame section and extending outwardly therefrom in a direction opposite of said head base frame;

a patient support surface coupled to said center frame section, said head base frame and said foot base frame;

a mattress for the bed, said patient support surface being adapted to provide support for said mattress, wherein the bed may be unfolded for use by a person with said head base frame, said center frame section and said foot base frame located in substantially the same plane, and wherein said head base frame and said foot base frame may be pivoted upwardly relative to said center frame section leaving said transport wheels in contact with the ground so that the bed is easily transportable from room to room; and a first high-low linkage assembly coupled to said head base frame and a second high-low linkage assembly coupled to said foot base frame, said first and second high-low linkages each being coupled to a mechanism adapted to manipulate said linkages to raise and lower the bed.

12. The rehabilitation bed of claim 11, wherein said mechanism is an electrically operated actuator.

13. The rehabilitation bed of claim 12, further comprising an anti-pivot bar adapted to be secured across said center frame section between said head base frame and said foot base frame when said bed is unfolded for use by a person, said anti-pivot bar preventing said foot base frame and said head base frame from pivoting with respect to said center frame section.

14. The rehabilitation bed of claim 13, further comprising a tube support coupled to said center frame section and a transport tube adapted to be removably received within said tube support, said transport tube being used when the bed is in a folded condition to provide support for the folded head base frame and foot base frame.

15. An easily transportable rehabilitation bed, comprising:

a center frame section having first and second ends;

at least one pair of transport wheels depending downwardly from said center frame section;

a head base frame pivotally coupled to said first end of said center frame section and extending outwardly away therefrom;

a foot base frame pivotally coupled to said second end of said center frame section and extending outwardly therefrom in a direction opposite of said head base frame;

a patient support surface coupled to said center frame section, said head base frame and said foot base frame;

a mattress for the bed, said patient support surface being adapted to provide support for said mattress, wherein the bed may be unfolded for use by a person with said head base frame, said center frame section and said foot base frame located in substantially the same plane, and wherein said head base frame and said foot base frame may be pivoted upwardly relative to said center frame section leaving said transport wheels in contact with the ground so that the bed is easily transportable from room to room; and a series of frame extensions pivotally coupled to at least said head base frame and said foot base frame, said extensions being pivotal between a first, inward position when a narrower mattress is used for the bed and a second outward position when a wider mattress is used for the bed, said extensions being easily moved between said first and second positions.

16. The rehabilitation bed of claim 15, wherein said transport wheels are pivotally coupled to said center frame section to be pivotal between a first position with said transport wheels extended and depending downwardly from said center frame section and a second position with said transport wheels retracted and generally adjacent said center frame section.

17. The rehabilitation bed of claim 16, wherein said patient support surface includes:

a center patient support spaced above and coupled to said center frame section;

a head patient support spaced above and pivotally coupled to said head base frame; and a foot patient support spaced above and pivotally coupled to said foot base frame, wherein said head and foot patient supports are independently manipulable into a number of positions.

18. The rehabilitation bed of claim 17, further comprising a first mechanism coupled to said foot patient support and a second mechanism coupled to said head patient support, said first and second mechanisms adapted to move said foot patient support and said head patient supports into a number of positions.

* * * * *